US008061797B2

(12) United States Patent
Mizutani

(10) Patent No.: US 8,061,797 B2
(45) Date of Patent: Nov. 22, 2011

(54) IMAGE RECORDING APPARATUS

(75) Inventor: Shunsuke Mizutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 503 days.

(21) Appl. No.: 12/243,771

(22) Filed: Oct. 1, 2008

(65) Prior Publication Data

US 2009/0087201 A1 Apr. 2, 2009

(30) Foreign Application Priority Data

Oct. 1, 2007 (JP) ..... 2007-258022

(51) Int. Cl.
*B41J 29/38* (2006.01)
*B41J 2/01* (2006.01)

(52) U.S. Cl. ..... 347/16; 347/5; 347/19; 347/101; 347/104

(58) Field of Classification Search ..... 347/16, 347/19, 104
See application file for complete search history.

(56) References Cited

U.S. PATENT DOCUMENTS 7,185,981 B2 * 3/2007 Tham et al. ..... 347/104
7,527,346 B2 5/2009 Izuchi

FOREIGN PATENT DOCUMENTS

JP 2001-063019 A 3/2001
JP 2006-116973 A 5/2006
JP 2006-150610 A 6/2006
JP 2007-038562 A 2/2007
JP 2007-091398 A 4/2007
JP 2007-105910 A 4/2007

OTHER PUBLICATIONS

Japan Patent Office; Notification of Reason for Refusal in Japanese Patent Application No. 2007-258022 (counterpart to the above-captioned U.S. patent application) mailed May 12, 2009.

* cited by examiner

*Primary Examiner* — Ryan Lepisto
(74) *Attorney, Agent, or Firm* — Baker Botts L.L.P.

(57) ABSTRACT

An image recording apparatus having a both-side printing function for ejecting ink to record images on a first face and a second face of a recording medium is provided. The image recording apparatus includes: a conveying unit which conveys the recording medium; a driving unit which drives the conveying unit; a conveying path along which the recording medium is conveyed; a holding unit which is provided on the conveying path and holds a part of the recording medium; and a controller which controls the image recording apparatus to enter a power saving mode of interrupting power supply to at least the driving unit in a state that the recording medium is held by the holding unit, after the image is recorded on the first face of the recording medium but before the image is recoded on the second face of the recording medium.

14 Claims, 8 Drawing Sheets

(PROCESSING BY CPU OF MULTIFUNCTION DEVICE)

FIG. 8A

| INTERRUPTION |
| --- |
| REGISTRATION SENSOR |
| ROTARY ENCODER |
| LINEAR ENCODER |
| BOTH-SIDE SURFACE SENSOR |
| BACK LIGHT OF LIQUID CRYSTAL DISPLAY PORTION |
| INK CARTRIDGE SENSOR |
| PORTIONS RELATED TO RECORDING HEAD |
| LF MOTOR |
| CR MOTOR |
| ⋮ |

FIG. 8B

| POWER SUPPLY |
| --- |
| PORTIONS RELATED TO USB |
| PORTIONS RELATED TO INTERFACE |
| LIQUID CRYSTAL DISPLAY PORTION |
| PORTIONS RELATED TO FACSIMILE |
| ⋮ |

IMAGE RECORDING APPARATUS

CROSS-REFERENCE TO RELATED APPLICATION

This application claims priority from Japanese Patent Application No. 2007-258022, filed on Oct. 1, 2007, the entire subject matter of which is incorporated herein by reference.

TECHNICAL FIELD

Aspects of the present invention relates to an image recording apparatus.

BACKGROUND

JP-A-2007-91398 describes an image forming apparatus having a both-side printing function in which a recording sheet is dried for a predetermined time after an image is recorded on a first face of the recording sheet but before an image is recorded on a second face of the recording sheet. According to this image forming apparatus, the recording sheet is dried in a state where the recording sheet is held vertically.

Recently, the image forming apparatus is intended to save power by interrupting the power supply to various kinds of sensors or the power supply to driving means for various kinds of motors under a specific condition.

For example, JP-A-2007-105910 describes an image forming apparatus which enters a power saving mode when an external personal computer is in a state being not capable of communicating, and therefore, the possibility of receiving a print request from the personal computer is low, thereby attain power saving.

A time required for drying a recording sheet corresponds a time required for drying ink and the like. Therefore, in general, it takes 30 seconds or more and almost 120 seconds at the maximum. Since the image forming apparatus is in a standby state and the execution of various kinds of functions are also stood while the recoding sheet is dried, there arises a problem that electric power is consumed wastefully.

Accordingly, in order to save power, it is considered to enter a power saving mode in which the power supply to the various kinds of sensors and motors is interrupted while a recording sheet is dried. However, particularly in the case where the recording sheet is held only vertically, the recording sheet may fall or may be misaligned while the power supply to the motors is interrupted.

As a result, there arise problems that a recording sheet is jammed within the image recording apparatus or non-dried ink adheres to and stains the recording sheet or the mechanism within the apparatus due to the falling or the positional misalignment of the recording sheet.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image recording apparatus which can prevent the falling and the positional misalignment of a recording sheet and can save power in a standby state before an image is recorded on a second face of the recording sheet.

According to an exemplary embodiment of the present invention, there is provided an image recording apparatus having a both-side printing function for ejecting ink to record images on a first face and a second face of a recording medium. The image recording apparatus includes: a conveying unit which conveys the recording medium; a driving unit which drives the conveying unit; a conveying path along which the recording medium is conveyed when the conveying unit is driven by the driving unit; a holding unit which is provided on the conveying path and holds a part of the recording medium; and a controller which controls the image recording apparatus to enter a power saving mode of interrupting power supply to at least the driving unit in a state that the recording medium is held by the holding unit, after the image is recorded on the first face of the recording medium but before the image is recoded on the second face of the recording medium.

According to another exemplary embodiment of the present invention, there is provided an image recording apparatus including: a conveying roller which feeds or conveys a recording medium along a conveying path in a conveying direction; an image recording unit which is provided along the conveying path and ejects ink on the recording medium conveyed by the conveying roller to form an image thereon; a discharge tray; a driven roller which is freely rotatable; a discharge roller which, while nipping the recording medium with the driven roller, discharges the recording medium recorded thereon to the discharge tray or conveys the recording medium recorded thereon to an inverse path which extends to an upstream of the conveying path in the conveying direction; a driving unit which drives the conveying roller and the discharge roller; a power controller which controls power supply to the driving unit to be interrupted in a state that the discharge roller nips the recording medium with the driven roller.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIGS. 8A and 8B are diagrams showing an example of a list of portions which are interrupted from the power supply and a list of portions which are continuously supplied with power at the time of entering a power saving mode.

DETAILED DESCRIPTION

Figure 1:
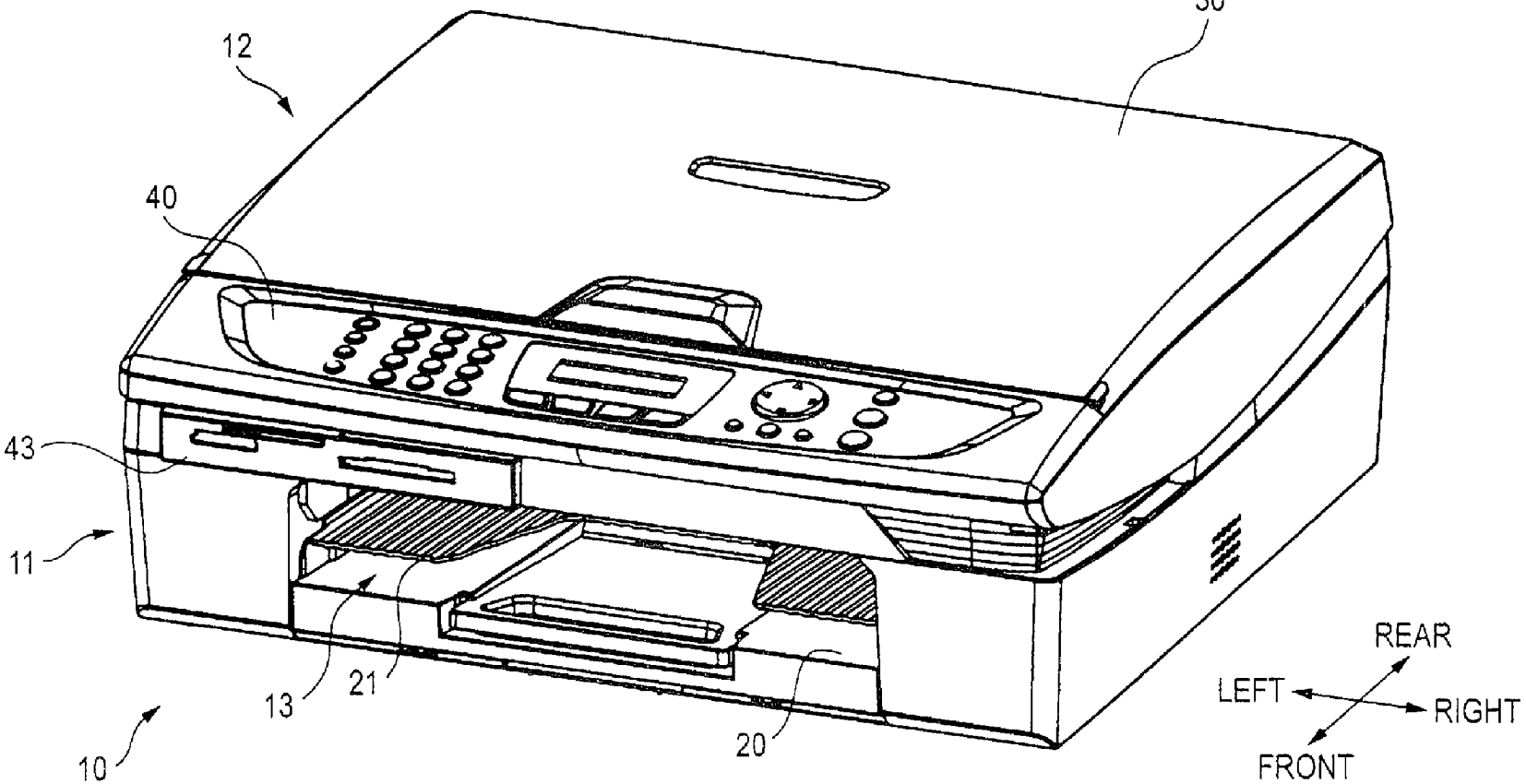
FIG. 1 is an external perspective view of a multifunction device according to an exemplary embodiment of the present invention.

Hereinafter, an exemplary embodiment of the present invention will be described with reference to accompanying drawings. First, the overall configuration of a multifunction device 10 will be described with reference to FIG. 1. FIG. 1 is an external perspective view of the multifunction device 10 according to an exemplary embodiment of the present invention.

The multifunction device 10 has various kinds of functions such as a telephone function, a facsimile function, a printer function, a scanner function and a copy function. Particularly, the multifunction device has a both-side printing function in the printer function. Since the facsimile function, the scanner function and the copy function of related art are employed in the multifunction device 10, the detailed explanation thereof will be omitted.

As shown in FIG. 1, the multifunction device 10 includes a printer portion 11 provided at the lower part thereof, a scanner portion 12 provided at the upper part thereof, an opening 13 in which a sheet feed tray 20 and a sheet discharge tray 21 are provided in upper and lower stages, a document cover 30 serving as a top plate, an operation panel 40 provided at the upper part of a front face thereof and a slot portion 43 provided at the front face thereof.

The scanner portion 12 is configured as a so-called flat bed scanner. The document cover 30 is provided as the top plate of the multifunction device 10 and a platen glass (not shown) is disposed below the document cover 30. A document is placed on the platen glass and is read as an image while the document is covered by the document cover 30.

The operation panel 40 is provided for operating the printer portion 11 and the scanner portion 12 and includes various kinds of operation buttons and a liquid crystal display portion. A user can perform setting and operations of the various kinds of functions by using the operation panel 40. For example, a user can set the kind (plain sheet or post card) of a recording sheet 103 (see FIG. 4) as a recording medium, set a one-side recording mode in which an image is recorded only on one face of the recording sheet 103, set a both-side recording mode in which images are recorded on both of front and rear faces of the recording sheet 103, and set a resolution (draft mode or photo mode).

The slot portion 43 receives various kinds of small memory cards as the recording medium inserted therein. For example, when a user operates the operation panel 40 while a small memory card is inserted into the slot portion 43, image data stored in the small memory card is read and the image data thus read can be recorded on the recording sheet 103.

Figure 2:
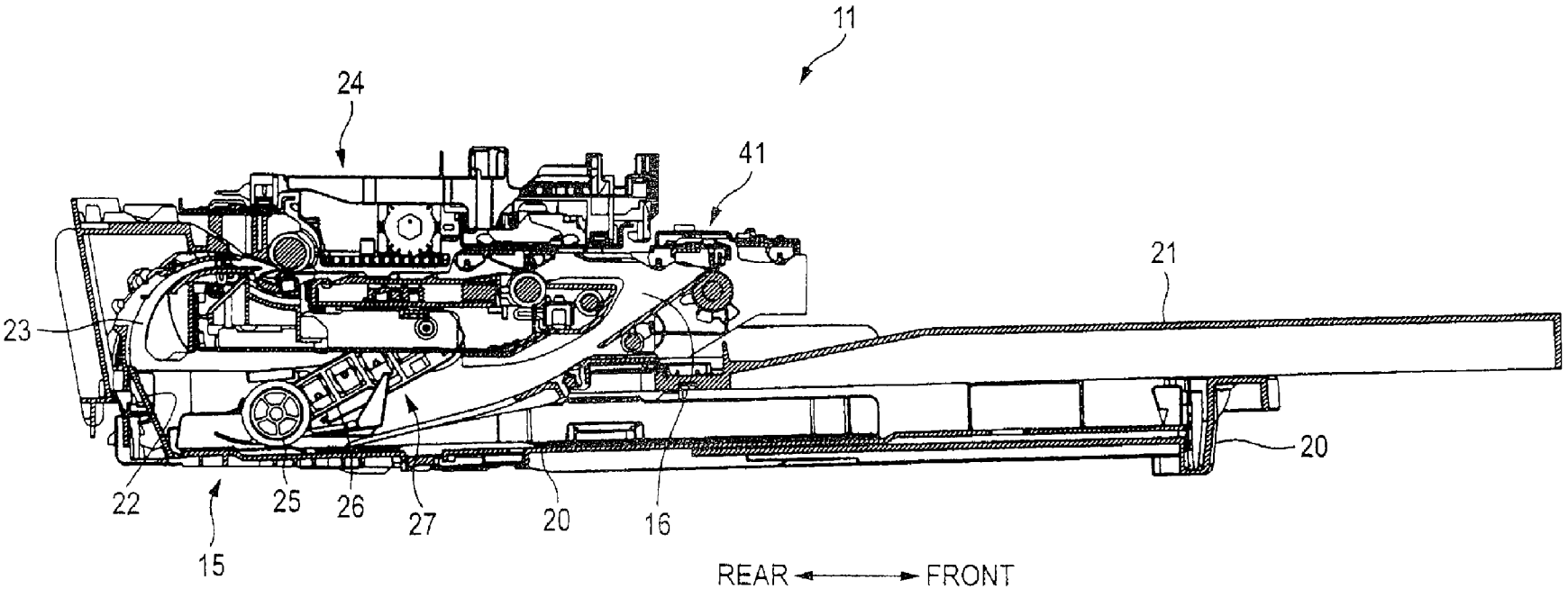
FIG. 2 is a longitudinal sectional diagram showing the structure of a printer portion of the multifunction device.

Next, the configuration of the printer portion 11 will be described. FIG. 2 is a longitudinal sectional diagram showing the structure of the printer portion 11 of the multifunction device 10.

As shown in FIG. 2, the printer portion 11 includes a conveying path 23 along which the recording sheet 103 as the recording medium is conveyed, an inversion guide portion 16 which guides the inverted recording sheet 103 to the conveying path 23, a feeding portion 15 which feeds the recording sheet 103 to the conveying path 23, a recording portion 24 which ejects ink drops onto the recording sheet 103 to thereby record an image thereon, a path switching portion 41 which switches a path of the recording sheet 103, and the sheet discharge tray 21 to which the recording sheet 103, on which an image has been recorded, is discharged.

The feeding portion 15 includes the sheet feed tray 20, a sheet feed arm 26, a sheet feed roller 25, and a power transmission mechanism 27 for driving the sheet feed roller 25.

The sheet feed tray 20 stores the recording sheets 103. The recording sheets 103 stored in the sheet feed tray 20 are fed into the printer portion 11. The sheet feed tray 20 is disposed on the bottom of the printer portion 11 and a separation plate 22 is slanted and provided at the rear side of the sheet feed tray 20. The separation plate 22 continues to the conveying path 23 and separates the recording sheets 103 fed from the sheet feed tray 20 in a stacked manner to thereby guide the uppermost one of the recording sheets 103 upward.

The conveying path 23 is bent in a U-shape to the front side after extending upward from the separation plate 22, then further extending to the front side (right side in FIG. 2) from the rear side (left side in FIG. 2) of the multifunction device 10 and communicated with the sheet discharge tray 21 via the recording portion 24.

Thus, the recording sheet 103 stored in the sheet feed tray 20 is guided from the lower portion to the upper portion along the conveying path 23 while turning in the U-shape and reaches the recording portion 24, then an image is recorded thereon by the recording portion 24 and discharged on the sheet discharge tray 21.

In the case of recording an image on the rear face (second face) of the recording sheet 103, the path switching portion 41 guides the recording sheet 103, the front face (first face) of which an image having been recorded on, to the inversion guide portion 16 to thereby convey the recording sheet 103 to the conveying path 23 again in an inverted state. Then, the recording portion 24 records an image on the rear face of the recording sheet 103 thus conveyed to the conveying path 23. In this manner, an image is recorded by the recording portion 24 on the rear face of the recording sheet 103 conveyed by the conveying path 23 again.

Figure 3:
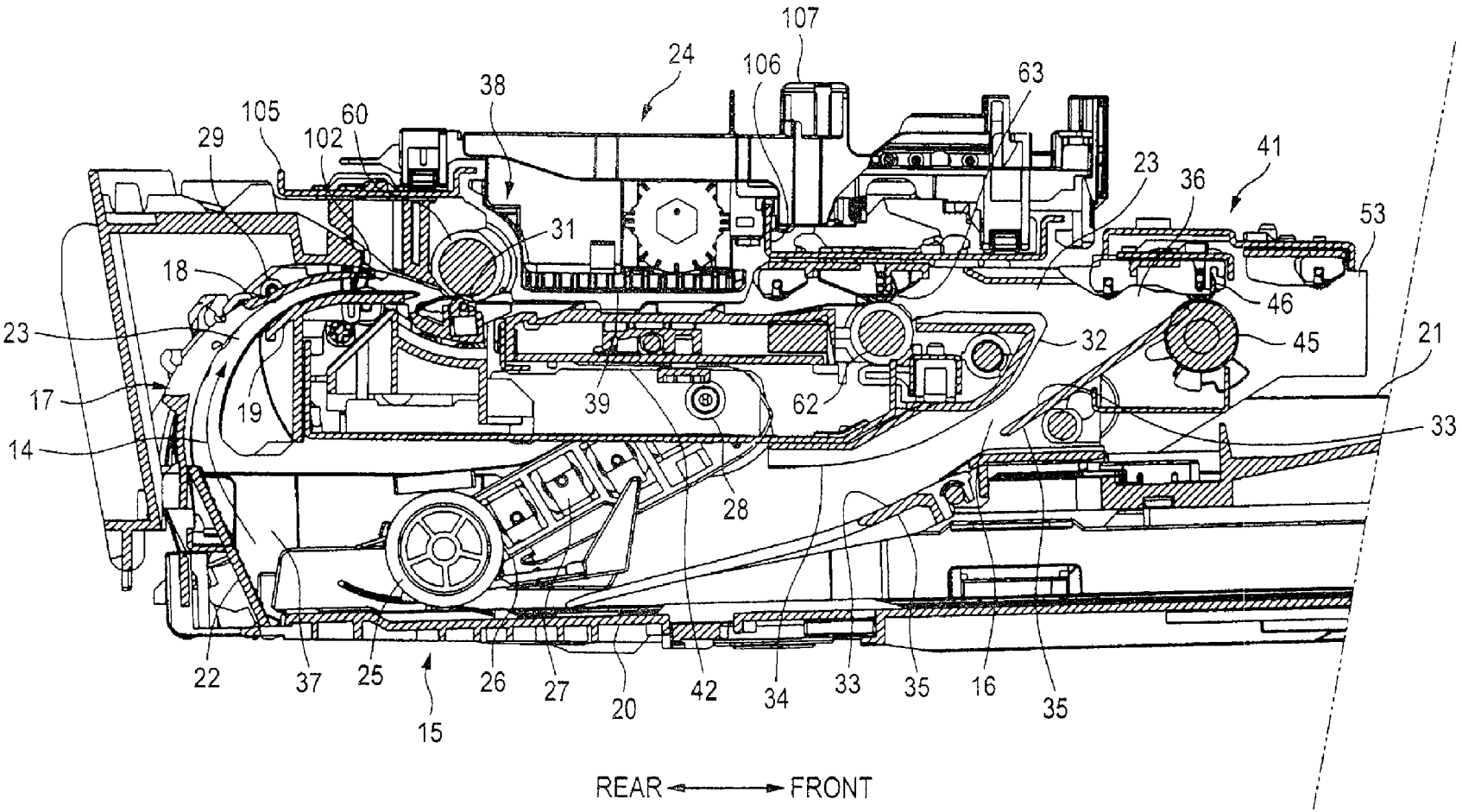
FIG. 3 is a sectional diagram of a partially enlarged portion of the printer portion.
Figure 4:
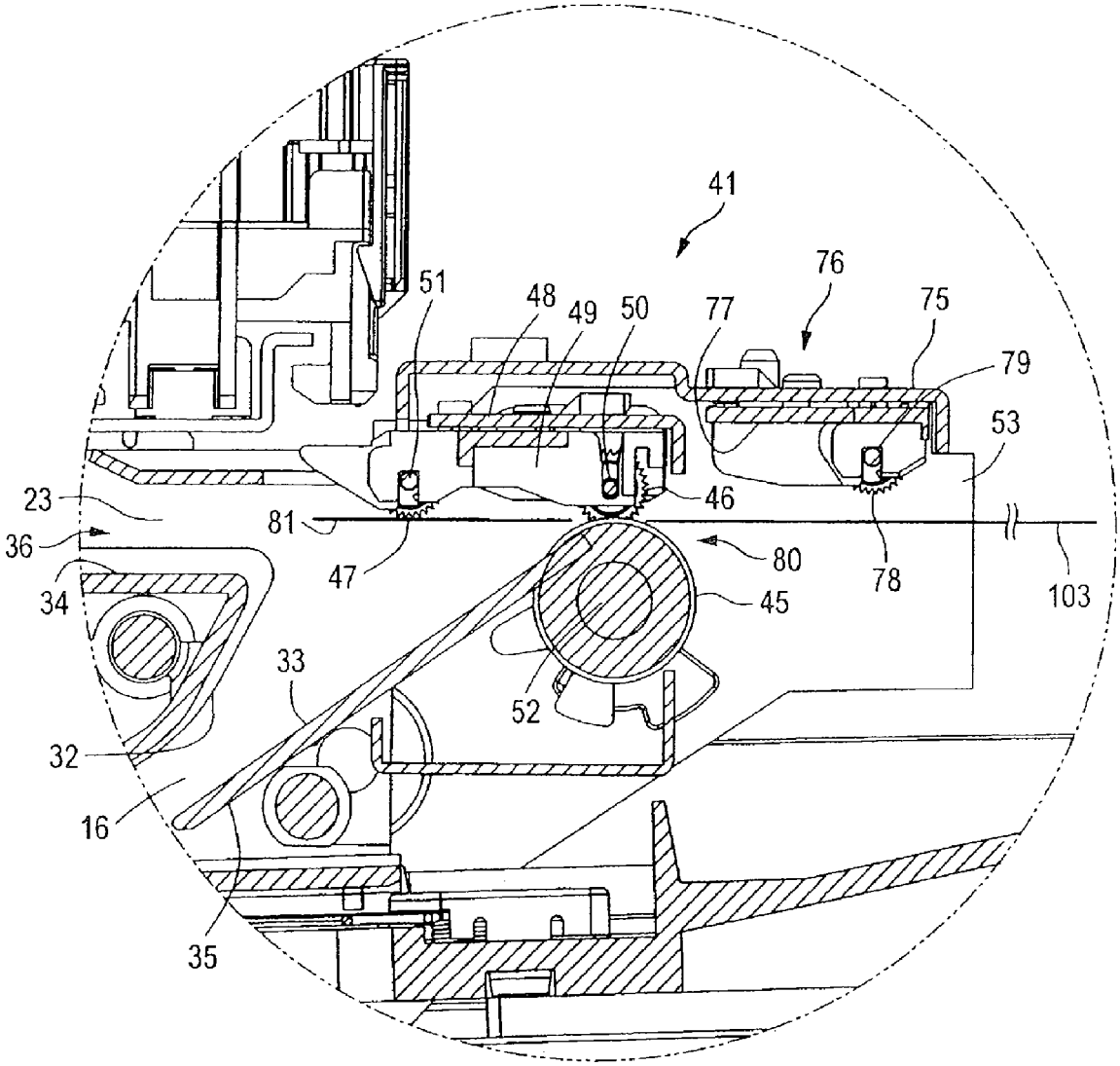
FIG. 4 is an enlarged sectional diagram showing the sectional structure in an enlarged manner near a path switching portion.

Next, the printer portion 11 will be described in detail with reference to FIGS. 3 and 4. FIG. 3 is a sectional diagram of a partially enlarged portion of the printer portion 11 and FIG. 4 is an enlarged sectional diagram showing the sectional configuration around the path switching portion 41.

As shown in FIG. 3, the sheet feed roller 25 is disposed above the sheet feed tray 20. The sheet feed roller 25 feeds the recording sheets 103 placed on the sheet feed tray 20 to the conveying path 23. The sheet feed roller 25 is rotatably supported at the tip end of the sheet feed arm 26. The sheet feed roller 25 is driven and rotated via the power transmission mechanism 27 by an LF motor 71 (see FIG. 5) as a driving source. The power transmission mechanism 27 includes a plurality of gears meshed with each other.

The sheet feed arm 26 is supported by a base shaft 28 at the base end portion thereof and is rotatable around the base shaft 28 as a rotation center shaft. Thus, the sheet feed arm 26 can move in up and down direction so as to be able to contact with and separate from the sheet feed tray 20. Further, the sheet feed arm 26 is urged so as to rotate downward due to its own weight, a spring or the like. Therefore, the sheet feed arm 26 normally contacts with the sheet feed tray 20 and is retracted to upper side when the sheet feed tray 20 is inserted or removed.

The feeding of the recording sheets 103 from the sheet feed tray 20 is performed while the sheet feed arm 26 is rotated downward, and then the sheet feed roller 25 rotates in a state that the sheet feed roller 25 is pressed against the recording sheets 103 on the sheet feed tray 20 to thereby feed the uppermost recording sheet 103 to the separation plate 22 by the friction generated between the roller surface of the sheet feed roller 25 and the recording sheet 103.

Then, when the tip end of the recording sheet 103 abuts against the separation plate 22, the recording sheet 103 is guided upward and fed to the conveying path 23 along an arrow 14. In the case of feeding the uppermost recording sheet 103 by the sheet feed roller 25, although there is a case that another recording sheet 103 just beneath the recording sheet 103 at the uppermost position is also fed due to the friction or static electricity, this another recording sheet 103 abuts against the separation plate 22 and stops.

The conveying path 23 is defined by an outer guide surface and an inner guide surface at an area other than an area where the recording portion 24 and the like are disposed. For example, a bent portion 17 of the conveying path 23 at the rear face side of the multifunction device 10 is formed by attaching an outer guide member 18 and an inner guide member 19 to a main body frame 53. In this case, the outer guide member 18 serves as the outer guide surface and the inner guide member 19 serves as the inner guide surface. Further, the outer guide member 18 and the inner guide member 19 are disposed so as to oppose to each other with a predetermined distance therebetween.

A roller 29 is provided at the bent portion of the conveying path 23. The roller 29 is supported freely rotatable. The roller surface of the roller 29 is exposed from the outer guide surface. Thus, the recording sheet 103 can be conveyed smoothly also at a portion where the conveying path 23 is bent.

The recording portion 24 is disposed on the way of the conveying path 23 and includes a carriage 38 and a recording head 39. The recording head 39 is mounted on the carriage 38 so as to reciprocate in the main scanning direction (a direction orthogonal to the drawing sheet in FIG. 3) along guide rails 105, 106. Specifically, the carriage 38 is slid via a belt driving mechanism, for example, by a CR motor 95 (see FIG. 5) as a driving source.

An ink cartridge (not shown) is disposed within the multifunction device 10 in an independent manner from the recording head 39. The ink is fed to the recording head 39 via an ink tube from the ink cartridge. While the carriage 38 is reciprocated, the ink is ejected from the recording head 39 as fine ink drops to thereby record an image on the recording sheet 103 conveyed on a platen 42.

The main body frame 53 of the multifunction device 10 is provided with a linear encoder 85 (see FIG. 5) for detecting the position of the carriage 38. An encoder strip of the linear encoder 85 is provided on the guide rails 105, 106. The encoder strip has light transmission portions for transmitting a light, and light shielding portions for shielding a light. The light transmission portions and the light shielding portions are arranged alternately with a predetermined pitch along the longitudinal direction of the encoder strip to form a predetermined pattern.

An optical sensor 107 of a transmission type sensor is provided on the upper surface of the carriage 38. Specifically, the optical sensor 107 is provided at the position corresponding to the encoder strip, and is reciprocated together with the carriage 38 along the longitudinal direction of the encoder strip to thereby detect the pattern of the encoder strip during the reciprocation.

Further, the carriage 38 is provided with a media sensor 86 (see FIG. 5) which detects a presence/non-presence of the recording sheet 103 on the platen 42. The media sensor 86 includes a light source and a light receiving element. A light emitted from the light source is irradiated on the recording sheet 103 having been conveyed on the platen 42 or irradiated on the platen when the recording sheet 103 has not been conveyed on the platen 42. Then, the light irradiated on the recording sheet 103 or the platen 42 is reflected at the surface thereof. The light receiving element receives the reflected light and outputs an output according to an amount of the received light. Accordingly, the media sensor 86 can detect a presence/non-presence of the recording sheet 103.

The inversion guide portion 16 is connected to the conveying path 23 and continues to the downstream side portion 36 of the conveying path 23 from the recording portion 24. The inversion guide portion 16 constitutes an inversion path for guiding the recording sheet 103, one face of which an image having been recorded on, again to the sheet feed tray 20. The inversion path is defined by a first guide surface 32 and a second guide surface 33.

In this exemplary embodiment, the first guide surface 32 and the second guide surface 33 are the surface of a guide member 34 and the surface of a guide member 35 disposed within the main body frame 53 of the multifunction device 10. The guide members 34, 35 are disposed opposite with each other with a predetermined distance therebetween. Each of the first guide surface 32 and the second guide surface 33 extends downward in a slanted manner toward the sheet feed roller 25 from the downstream side portion 36 of the conveying path 23.

In this exemplary embodiment, although the inversion guide portion 16 is configured to return the recording sheet 103 on the sheet feed tray 20, the present invention is not limited thereto. It is sufficient to configure the inversion guide portion 16 so as to be able to connect the downstream side portion 36 of the conveying path 23 with an upstream side portion 37. Thus, it is sufficient that the recording sheet 103 is returned to the sheet feed tray 20 side than the upstream side portion 37.

A conveyance roller 60 and a pinch roller 31 are provided on the upstream side of the conveying path 23 from the recording portion 24. The pinch roller 31 is disposed so as to pressingly contact with the lower side of the conveyance roller 60. The conveyance roller 60 and the pinch roller 31 hold (nip) therebetween the recording sheet 103 conveyed along the conveying path 23 and convey the recording sheet 103 on the platen 42.

A sheet discharge roller 62 and spur rollers 63 are provided on the downstream side of the conveying path 23 from the recording portion 24. The sheet discharge roller 62 and the spur rollers 63 hold therebetween the recording sheet 103 recorded thereon and convey the recording sheet 103 further to the downstream side (sheet discharge tray 21 side) in the conveying direction from the conveying path 23.

The conveyance roller 60 and the sheet discharge roller 62 are driven by the LF motor 71 as the driving source. The conveyance roller 60 and the sheet discharge roller 62 are driven synchronously and driven intermittently at the time of recording an image. Thus, an image is recorded on the recording sheet 103 while being conveyed at a predetermined line width.

Figure 5:
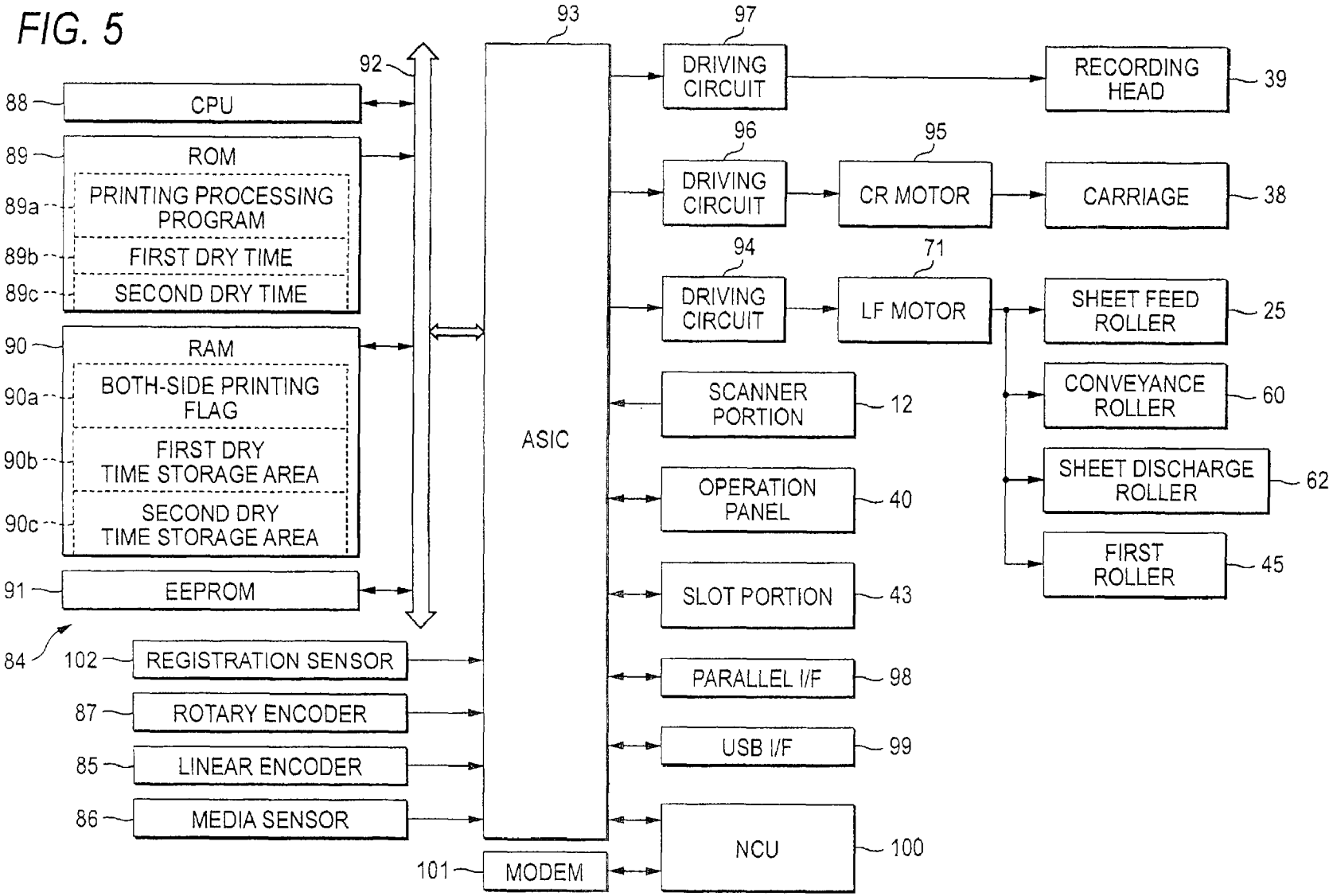
FIG. 5 is a block diagram showing the configuration of a control portion of the multifunction device.

A rotary encoder 87 is provided for the conveyance roller 60 (see FIG. 5). The rotary encoder 87 is configured such that an optical sensor detects the pattern of an encoder disc (not shown) which rotates together with the conveyance roller 60, whereby the rotation of the conveyance roller 60 and the sheet discharge roller 62 are controlled based on a signal detected by the optical sensor. It is noted that the conveyance roller 60 and the sheet discharge roller 62 are driven continuously before and after the image recording, whereby the quick sheet conveyance is realized.

The spur rollers 63 presses against the recording sheet 103 recorded thereon. The roller surface of each of the spur rollers 63 is formed so as to be uneven in a spur manner so that an image recorded on the recording sheet 103 does not degrade.

Each of the spur rollers 63 is provided so as to be slidable in a direction along which the spur roller contacts with and separates from the sheet discharge roller 62 and is urged to pressingly contact with the sheet discharge roller 62. Typically, a coil spring is employed as a means for urging the spur rollers 63 toward the sheet discharge roller 62.

Although not shown in FIG. 3, in this exemplary embodiment, a plurality of the spur rollers 63 are provided in a manner that these spur rollers 63 are disposed with the same interval in parallel in a direction orthogonal to the conveying direction of the recording sheet 103, that is, in the width direction of the recording sheet. The number of the spur rollers 63 is not limited to a particular number and is set to eight in this exemplary embodiment.

When the recording sheet 103 enters between the sheet discharge roller 62 and the spur rollers 63, the spur rollers 63 are retracted against the urging force of the coil spring by a length corresponding to the thickness of the recording sheet 103. The recording sheet 103 is pressed against the sheet discharge roller 62, whereby the rotation force of the sheet discharge roller 62 is surely transmitted to the recording sheet 103. Further, the pinch roller 31 is also elastically urged against the conveyance roller 60 in the similar manner. Thus, the recording sheet 103 is pressed against the conveyance roller 60, whereby the rotation force of the conveyance roller 60 is surely transmitted to the recording sheet 103.

A registration sensor 102 (see FIG. 5) is provided on the upstream side from the conveyance roller 60. The registration sensor 102 includes a detector and an optical sensor. The detector is disposed to cross the conveying path 23 so as to protrudable into and retractable from the conveying path 23. The detector is elastically urged to normally protrude into the conveying path 23. When the recording sheet 103 being conveyed on the conveying path 23 abuts against the detector, the detector is retracted from the conveying path 23. The optical sensor is turned on and off according to the protrusion and retraction of the detector. Thus, since the recording sheet 103 allows the detector to protrude and retract, the tip and the rear end of the recording sheet 103 on the path can be detected.

In the multifunction device 10, the LF motor 71 serves as a driving source for feeding the recording sheet 103 form the sheet feed tray 20, a driving source for conveying the recording sheet 103 on the platen 42 and discharging the recording sheet 103 recorded thereon to the sheet discharge tray 21, and further as a driving source for driving the sheet discharge roller 62 via a predetermined power transmission mechanism. That is, the LF motor 71 drives the conveyance roller 60, the sheet feed roller 25 via the power transmission mechanism 27 and further drives the sheet discharge roller 62 via the predetermined power transmission mechanism. The predetermined power transmission mechanism may be configured by a gear train, a timing belt or the liked depending on the space for the assembling thereof, for example.

As shown in FIGS. 3 and 4, the path switching portion 41 is disposed on the downstream side from the recording portion 24 on the conveying path 23. Specifically, the path switching portion 41 is disposed on the downstream side in the conveying direction at the downstream side portion 36 on the downstream side from the recording portion 24 in the conveying path 23. In other words, the path switching portion 41 is disposed at the boundary portion between the conveying path 23 and the inversion guide portion 16. The path switching portion 41 includes a first roller 45 and second rollers 46, and assistant rollers 47 which are provided in parallel with the second rollers 46.

The first roller 45 and the second rollers 46 hold therebetween the recording sheet 103 conveyed from the sheet discharge roller 62 and the spur rollers 63. The first roller 45 and the second rollers 46 can convey the recording sheet 103 to the downstream side (sheet discharge tray 21 side) in the conveying direction along the conveying path 23 and also can convey the recording sheet 103 to the inversion guide portion 16.

The second rollers 46 and the assistant rollers 47 are supported by a frame 48. The frame 48 extends in the transverse direction of the multifunction device 10 (a direction orthogonal to the plane of the drawing sheet in FIG. 3). The frame 48 has an almost L shape cross section as shown in FIG. 4, whereby the required flexural rigidity of the frame 48 is secured.

The frame 48 includes eight integrated sub-frames 49. The sub-frames 49 are disposed symmetrically in the transverse direction with respect to the center of the multifunction device 10. Each of the sub-frames 49 includes the second roller 46 and the assistant roller 47. Thus, the frame 48 includes eight second rollers 46 and eight assistant rollers 47. Each of the second rollers 46 and the assistant rollers 47 are disposed in parallel to each other with the same interval in a direction orthogonal to the conveying direction of the recording sheet 103, that is, in the width direction of the recording sheet 103. As described above, although the spur rollers 63 are also disposed in parallel to each other with the same interval in the width direction of the recording sheet 103, each of the spur rollers 63 is supported by the supporting structure similar to that of the second roller 46.

The second roller 46 and the assistant roller 47 are supported by supporting shafts 50, 51 (see FIG. 4) provided at each of the sub-frames 49 so as to be freely rotatable around the supporting shafts 50, 51, respectively. In this exemplary embodiment, each of the second roller 46 and the assistant roller 47 is formed in a spur shape, that is, a jagged shape. The assistant rollers 47 are disposed on the upstream side in the conveying direction from the second rollers 46 by a predetermined distance. Each of the second rollers 46 is urged downward by a spring (not shown) or the like so as to be elastically urged against the first roller 45 always.

The first roller 45 is coupled with the LF motor 71 via a predetermined power transmission mechanisms and is driven and rotated by the LF motor 71 as a driving source. Further, the first roller 45 includes a center shaft 52 which is supported on the main body frame 53 side of the multifunction device 10.

The second rollers 46 are placed above the first roller 45. The first roller 45 may be formed as a single elongated columnar shape or may be formed by eight rollers so as to oppose to the second rollers 46, respectively.

The first roller 45 is rotated in the forward and reverse directions so as to be able to convey the recording sheet 103 to the sheet discharge tray 21 and to the inversion guide portion 16. That is, the recording sheet 103 conveyed along the conveying path 23 is held between the first roller 45 and the second rollers 46. When the first roller 45 rotates in the forward direction, the recording sheet 103 is conveyed on the downstream side in the conveying direction while being held between the first roller 45 and the second rollers 46 and discharged onto the sheet discharge tray 21. On the other hand, when the first roller 45 rotates in the reverse direction, the recording sheet 103 is returned to the upstream side in the conveying direction while being held between the first roller 45 and the second rollers 46.

In this exemplary embodiment, the outer diameter of the first roller 45 is set to be slightly larger than that of the sheet discharge roller 62. That is, when each of the first roller and the sheet-discharge motor is driven at the same rotation speed, the peripheral speed of the first roller 45 is larger than that of the sheet discharge roller 62. Thus, when the recording sheet 103 is conveyed by both the sheet discharge roller 62 and the first roller 45, the recording sheet 103 is always pulled toward the conveying direction.

Figure 7A:
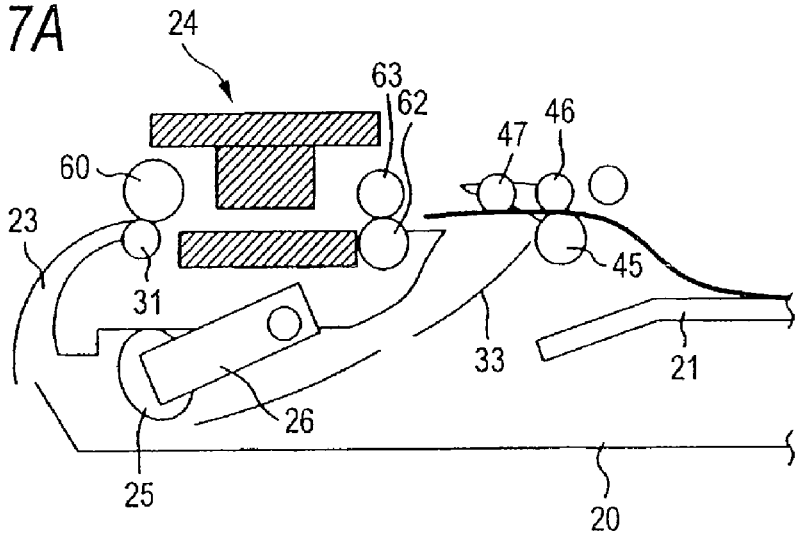
FIGS. 7A to 7C are schematic diagrams showing the path switching portion which changes a state thereof and the positions of the recording sheet in the case of printing a rear face.
Figure 7B:
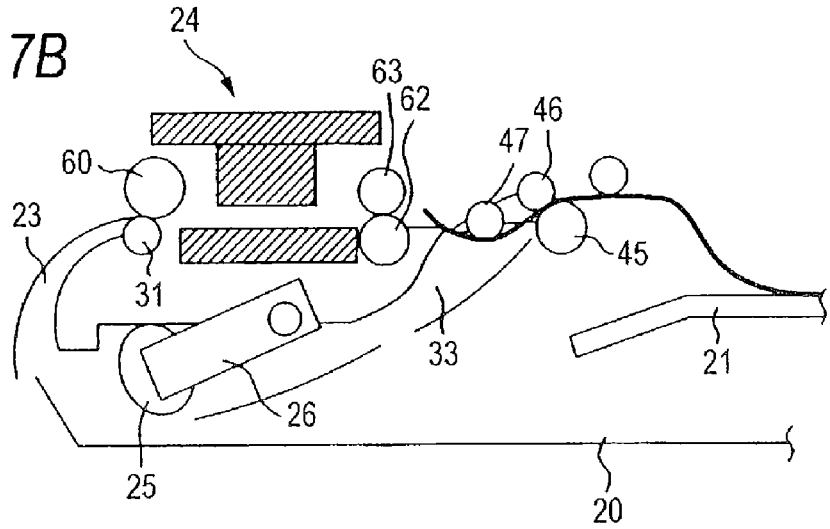
Figure 7C:
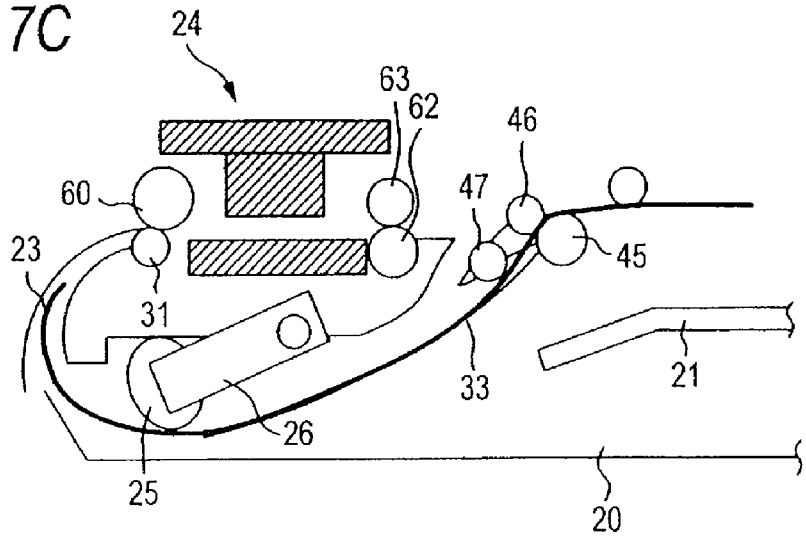

The path switching portion 41 changes the posture among a first posture for conveying the recording sheet 103 to the sheet discharge tray 21 (see FIG. 7A), a second posture for placing the sheet in a standby state before recording an image on the rear face of the recording sheet 103 (see FIG. 7B), and a third posture for conveying the recording sheet 103 to the inversion guide portion 16 (see FIG. 7C). When the path switching portion 41 changes its posture, the frame 48, the sub-frames 49, the first roller 45 and the assistant rollers 47 rotate integrally around the center axis 52 as the rotation center.

The guide portion 76 is provided on the downstream side in the conveying direction from the first roller 45 and the second rollers 46. A supporting plate 75 is attached to the main body frame 53 and the guide portion 76 is attached to the supporting plate 75. The guide portion 76 includes a base portion 77 fixed to the lower surface of the supporting plate 75 and a guide roller 78 supported by the base portion 77. The base portion 77 includes a supporting shaft 79 and the guide roller 78 is supported by the supporting shaft so as to be freely rotatable. In this exemplary embodiment, the guide roller 78 is formed in a spur shape, that is, a jagged shape.

The guide portion 76 is disposed at a specific position. That is, when the first roller 45 and the second rollers 46 rotate in the reverse direction to thereby convey the recording sheet 103 to the inversion guide portion 16, the guide portion 76 contacts with the recording face of the recording sheet 103. Further, when the first roller 45 and the second rollers 46 rotate in the forward direction to thereby convey the recording sheet 103 to the sheet discharge tray 21, the guide portion does not contact with the recording sheet 103. Specifically, the guide portion 76 is provided at a position not contacting with a virtual line connecting the contact point between the first roller 45 and the second roller 46 with the contact point between the sheet discharge roller 62 and the spur roller 63.

When the recording sheet 103 changes its conveying direction and is conveyed to the inversion guide portion 16, a portion of the recording sheet 103 on the downstream side from the first roller 45 and the second rollers 46 tends to change its direction to a direction parallel to the inversion guide portion 16 due to the rigidity of the recording sheet 103. However, the guide roller 78 abuts against the recording face of the recording sheet 103 to bend the recording sheet 103. Thus, since the recording sheet 103 is wound around the first roller 45 and the second rollers 46, a stable conveyance force can be obtained, whereby the recording sheet 103 is conveyed to the inversion guide portion 16 surely.

Next, the configuration of the control portion 84 of the multifunction device 10 will be described with reference to FIG. 5. FIG. 5 is a block diagram showing the configuration of the control portion 84 of the multifunction device 10. The control portion 84 controls the entire operation of the multifunction device 10 including the scanner portion 12 as well as the printer portion 11. However, since the scanner portion 12 is not the major configuration of the present invention, the description thereof is omitted.

As shown in FIG. 5, the control portion 84 is configured as a microcomputer including a Central Processing Unit (CPU) 88, a Read Only Memory (ROM) 89, a Random Access Memory (RAM) 90 and an Electronically Erasable and Programmable ROM (EEPROM) 91 and is coupled to an Application Specific Integrated Circuit (ASIC) 93 via a bus 92.

The ROM 89 stores therein a program and the like for controlling the various kinds of operations of the multifunction device 10. For example, the ROM stores therein a printing processing program 89*a* for executing the printing processing. Further, the ROM 89 stores therein a first dry time 89*b* and a second dry time 89*c*. A dry time in a first dry standby state described later is stored as the first dry time 89*b* and a dry time in a second dry standby state described later is stored as the second dry time 89*c*. In this exemplary embodiment, first dry time is 60 seconds and the second dry time is 30 seconds, and values corresponding to these dry times are stored in advance as the first dry time 89*b* and the second dry time 89*c*, respectively.

The RAM 90 is used as a storage area or a work area for temporarily storing various kinds of data used when the CPU 88 executes the program. The RAM 90 is provided with a both-side printing flag 90*a* representing that the both-side printing is set at the time of performing the printing (recording) using the printer function, a first dry time storage area 90*b* for storing the value of the first dry time 89*b* and a second dry time storage area 90*c* for storing the value of the second dry time 89*c*.

A user can arbitrary set the on/off state of the both-side printing flag 90*a* by operating the operation panel 40. The value read from the first dry time 89*b* or the second dry time 89*c* is stored in the first dry time storage area 90*b* or the second dry time storage area 90*c* at the time of starting the printing processing or turning on the power supply of the multifunction device 10.

The ASIC 93 performs the rotation control of the LF motor 71 in a manner that the ASIC generates a phase excitation signal and the like for supplying a current to the LF motor 71 in accordance with an instruction from the CPU 88 and supplies the signal to the driving circuit 94 of the LF motor 71, whereby a driving signal is applied to the LF motor 71 via the driving circuit 94.

The driving circuit 94 is for driving the LF motor 71 coupled to the sheet feed roller 25, the conveyance roller 60, the sheet discharge roller 62, the first roller 45 and the like and generates an electric signal for rotating the LF motor 71 in response to the output signal from the ASIC 93. The LF motor 71 rotates in response to the electric signal, whereby the rotation force of the LF motor 71 is transmitted to the sheet feed roller 25, the conveyance roller 60, the sheet discharge roller 62, the first roller 45 via a related-art driving mechanism configured by a gear, a driving shaft and the like.

Further, the ASIC 93 performs the rotation control of the CR (carriage) motor 95 such that the ASIC generates a phase excitation signal and the like for supplying a current to the CR motor 95 in accordance with an instruction from the CPU 88 and supplies the signal to the driving circuit 96 of the CR motor 95, whereby a driving signal is applied to the CR motor 95 via the driving circuit 96.

The driving circuit 96 is for driving the CR motor 95 coupled to the carriage 38 and generates an electric signal for driving the CR motor 95 in response to the output signal from the ASIC 93. The CR motor 95 rotates in response to the electric signal, whereby the rotation force of the CR motor 95 is transmitted to the carriage 38 to thereby reciprocate the carriage 38.

A driving circuit 97 is for selectively ejecting ink to the recording sheet 103 at a specific timing from the recording head 39 and drives and controls the recording head 39 in response to the output signal generated from the ASIC 93 based on the driving control procedure outputted from the CPU 88.

The ASIC 93 is coupled to the scanner portion 12, the operation panel 40 for instructing the operation of the multifunction device 10, the slot portion 43 in which various kinds of small memory cards are inserted, a parallel interface (I/F) 98 and an USB interface 99 each for transmitting/receiving data to/from an external device such as a personal computer via a parallel cable or a USB cable, an Network Control Unit (NCU) 100 for realizing the facsimile function and a modem (MODEM) 101.

Further, the ASIC 93 is coupled to the registration sensor 102 which detects that the recording sheet 103 is conveyed near the conveyance roller 60 from the sheet feed roller 25, the rotary encoder 87 which detects the rotation amounts of the respective rollers (the sheet feed roller 25, the conveyance roller 60 and the first roller 45 in this exemplary embodiment) driven by the LF motor 71, the linear encoder 85 which detects the moving amount of the carriage 38, and the media sensor 86 which detects the presence/non-presence of the recording sheet 103 on the platen 42.

Next, the description will be made as to the processing relating to the printer function executed by the control portion 84 of the multifunction device 10. When the power source of the multifunction device 10 is turned on, the carriage 38 is once moved to the slide end thereof to thereby initialize the detection position of the linear encoder 85. When the carriage 38 moves slidably from the initial position, the optical sensor 107 provided at the carriage 38 detects the pattern of the encoder strip.

The control portion 84 grasps the moving amount of the carriage 38 in accordance with the number of the pulse signal based on the detection of the optical sensor 107 and controls the rotation of the CR motor 95 so as to control the reciprocation of the carriage 38 based on the moving amount. Further, the control portion 84 grasps the position of the tip end or the rear end of the recording sheet 103 and the conveyed amount of the recording sheet 103 based on the output signal of the registration sensor 102 and an encoder amount detected by the rotary encoder 87.

When the tip end of the recording sheet 103 reaches the predetermined position of the platen 42, the control portion 84 controls the LF motor 71 so as to convey the recording sheet 103 intermittently at the predetermined line width. The line width is set based on a resolution and the like inputted as the condition of the image recording. In particular, when a high-resolution recording, more particularly, a borderless image recording is performed, the control portion 84 accurately detects the tip end and the rear end of the recording sheet 103 based on the detection of the presence of the recording sheet 103 by the media sensor 86 and the encoder amount detected by the rotary encoder 87.

Further, the control portion 84 accurately detects the positions of the both side ends of the recording sheet 103 based on the detection of the presence of the recording sheet 103 by the media sensor 86 and the encoder amount detected by the rotary encoder 87. The control portion 84 controls the ejection of the ink drops by the recording head 39 based on the positions of the tip end, the rear end and the both side ends of the sheet detected in this manner.

Figure 6:
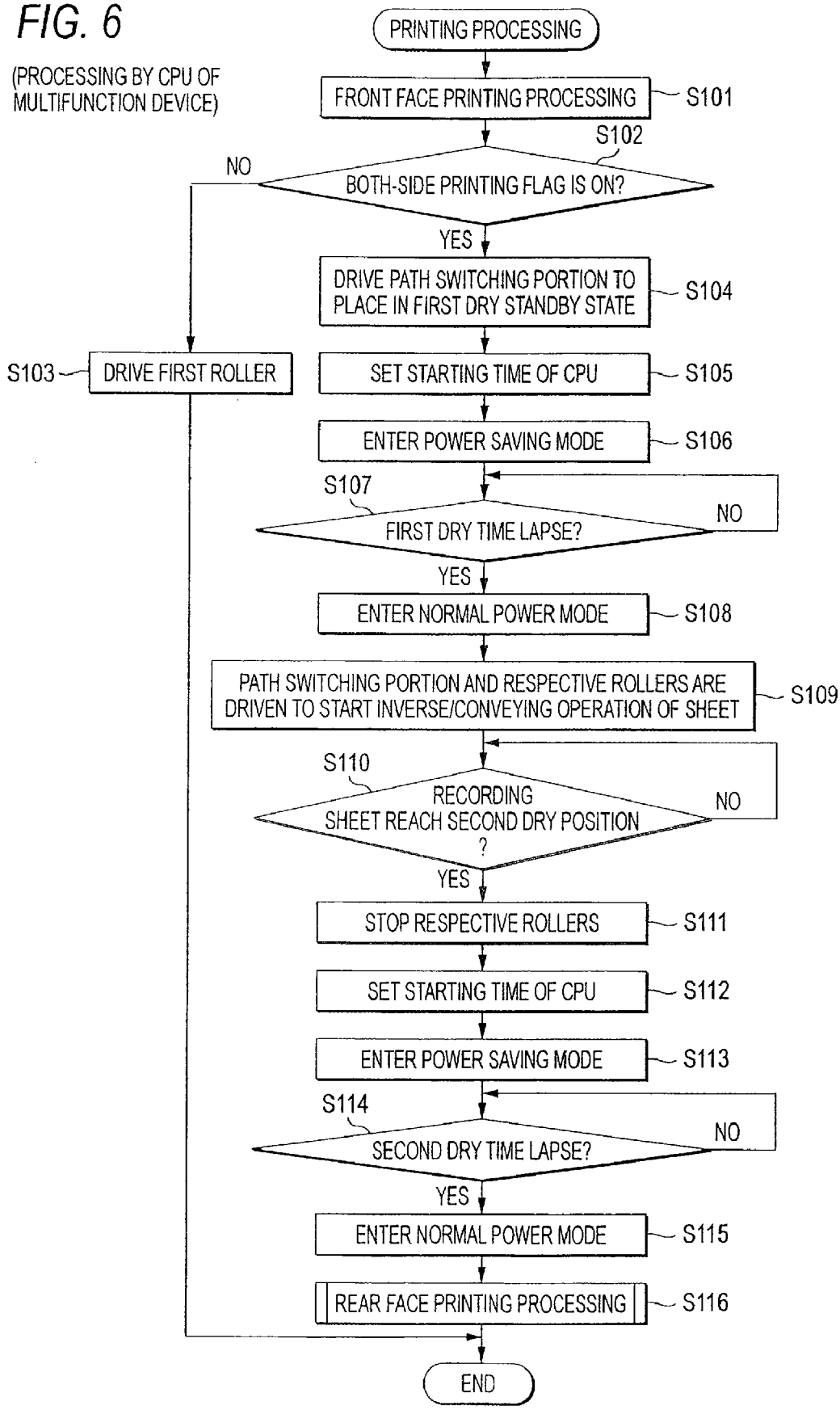
FIG. 6 is a flowchart showing a printing processing executed by a CPU of the multifunction device.

Next, the printing processing executed by the CPU 88 of the multifunction device 10 will be described with reference to FIGS. 6 to 8B. FIG. 6 is a flowchart showing the printing processing executed by the CPU 88 of the multifunction device 10. FIGS. 7A to 7C are schematic diagrams showing the path switching portion 41 which changes a state thereof and the positions of the recording sheet 103 in the case of printing the rear face. FIG. 8A is an example of a list of the portions which are interrupted from the power supply at the time of entering a power saving mode and FIG. 8B is an example of a list of the portions which are continuously supplied with power at the time of entering the power saving mode.

The printing processing is performed when a user operates the operation panel 40 to select the printer function to thereby start the printing operation. Since one aspect of the present invention resides in that the operation mode enters the power saving mode during the dry time of the recording sheet 103 after the front face thereof is printed, the explanation of the processing other than the entering operation to the power saving mode will be omitted. Further, as to FIGS. 7A to 7C, since the operation other than the posture change of the path switching portion 41 is same as the aforesaid contents, the detailed explanation thereof will be omitted.

When the printing processing is performed, first the front face printing processing is performed at operation S101. The front face printing processing at operation S101 is a series of operations performed in a manner that a recording sheet 103 is fed from the sheet feed tray 20, then an image is recorded by the recording portion 24 and the recording sheet 103 is conveyed to the path switching portion 41. Thus, when the front face printing processing at operation S101 is completed, the recording sheet 103 is placed in a state that rear end portion thereof in the conveying direction is held between the first roller 45 and the second rollers 46 as shown in FIG. 7A.

As shown in FIG. 7A, in the state where the front face printing processing at operation S101 is completed, the rear end portion of the recording sheet 103 in the conveying direction is held between the first roller 45 and the second rollers 46 and the rear tip end of the recording sheet 103 in the conveying direction reaches near the first guide surface 32. Further, almost of the recording sheet 103 is discharged on the sheet discharge tray 21 so that the recording sheet is supported by the sheet discharge tray 21 from the lower side.

Next, it is confirmed whether the both-side printing flag 90*a* is ON at operation S102. If the both-side printing flag 90*a* is OFF (No in S102), since a user sets the one-side printing, the first roller 45 is driven in the forward direction at operation S103 and then the processing is completed.

When the first roller 45 is driven in the forward direction at operation S103, the recording sheet 103, the front face of which an image has been recorded on, is discharged on the sheet discharge tray 21. The driving operation of the first roller 45 in the forward direction is performed during a time period sufficient for discharging the recording sheet 103 on the sheet discharge tray 21.

In contrast, if the both-side printing flag 90*a* is ON (Yes in S102), since a user sets the both-side printing, the path switching portion 41 is driven to place in the first dry standby state at operation S104. Specifically, the frame 48, the subframes 49, the second rollers 46 and the assistant rollers 47 are rotated integrally to the intermediate position around the center axis 52 (see FIG. 4) as the rotation center in the first dry standby state.

The first dry standby state is a state shown in FIG. 7B in which the rear end portion in the conveying direction (a portion being the front end portion in the conveying direction at the time of recording the rear face) of the recording sheet 103 bends near the first guide surface 32 so as to have a bent portion. Thus, since the recording sheet 103 now has the bent portion in the first dry standby state, the front tip end of the recording sheet 103 is directed upward when the recording sheet reaches the sheet feed roller 25 via the inversion guide portion 16. Thus, since the recording sheet 103 can surely enters into the platen 42, the sheet can be conveyed smoothly while suppressing the jam of the sheet or the like.

When the recording sheet 103 is set to the first dry standby state in the processing at operation S104, the value stored in the first dry time storage area 90*b* of the RAM 90 is read and the starting time of the CPU 88 is set at operation S105. In this exemplary embodiment, since the dry time of the first dry standby state is set to be 60 seconds in advance, the operation S108 and the succeeding operations of the printing processing are started after 60 seconds.

When the starting time of the CPU 88 is set at operation S105, the multifunction device 10 enters the power saving mode at operation S106. The power saving mode is a mode for temporarily interrupting the power supply to the various kinds of the driving means and sensors. Also almost all of the operations executed by the CPU 88 are stopped and enters a sleeping state.

The explanation will be made with reference to FIGS. 8A and 8B as to an example of the portions to which the power supply is interrupted and the portions to which the power supply is continued when entering the power saving mode.

As shown in FIG. 8A, when entering the power saving mode, the power supply to various kinds of sensors and the like is interrupted, such as the registration sensor 102 which detects the presence/non-presence of a recording sheet 103, the rotary encoder 87 which detects the rotary amounts of the respective rollers, the linear encoder 85 which detects the moving amount of the carriage 38, a both-side face sensor (shown only in FIG. 8) which detects the state of the path switching portion 41, the back light (shown only in FIG. 8) of the liquid crystal display portion provided at the operation panel 40 and an ink cartridge sensor (shown only in FIG. 8) which detects the presence/non-presence of the ink cartridge.

If the multifunction device 10 is configured so as to be able to attach an automatic document feeder which automatically feeds recording sheets 103 from a portion other than the sheet feed tray 20, the power supply interruption is made also as to a sensor for detecting the presence/non-presence of the automatic document feeder and a sensor provided at the automatic sheet feeder which detects the presence/non-presence of a recording sheet 103.

Further, as shown in FIG. 8A, when entering the power saving mode, the power supply to portions relating to the recording head 39, the LF motor 71 and the CR motor 95 is also interrupted. The portions relating to the recording head 39 includes an actuator and the like for ejecting an ink.

As described above, when entering the power saving mode, the power supply to the input system such as the sensors and the output system such as the motors are interrupted, and therefore, an amount of the consumption power consumed by the whole multifunction device 10 can be suppressed.

Further, as shown in FIG. 8A, when entering the power saving mode, the power is continuously supplied to the portions relating to the USB, the portions relating to the interface, the liquid crystal display portion provided at the operation panel 40 and the portions relating to the facsimile. That is, the apparatus is configured to continuously supply the electric power to the devices for receiving signals or data from the outside even when entering the power saving mode. Accordingly, it is possible to prevent the signals or data from the outside from being missed to take.

The devices for receiving signals or data from the outside are a USBI/F99, the parallel I/F 98, the NCU 100, the modem 101 and the like, for example. Although not shown, the devices include a LAN board or a radio communication board for transmitting/receiving signals or data to/from the outside.

The description will be made as to the processing proceeding to operation S107 of the printing processing with reference to FIG. 6.

At the operation S107, after entering the power saving mode, it is confirmed whether a clock circuit of the CPU 88 has counted the number corresponding to 60 seconds, that is, whether the first dry time has lapsed at operation S107 and the power saving mode is continued until the first dry time lapses (No in S107).

Then, at operation S107, when it is determined that the first dry time has lapsed after entering the power saving mode (Yes in S107), the multifunction device 10 enters a normal power mode at operation S108. At the operation S108, the power is supplied again to the various kinds of the sensors and motors to which the power supply is interrupted after entering the power saving mode, and the operation S108 and the succeeding operations of the printing processing are executed by the CPU 88 having been in the sleeping state.

At the operation S109, the path switching portion 41 and the respective rollers are driven to invert the recording sheet 103 and the conveyance of the recording sheet 103 thus inverted is started at operation S109. Specifically, the first roller 45 is driven and slightly rotated in the forward direction to thereby convey the recording sheet 103 until the rear tip end of the recording sheet 103 separates from the first guide surface 32 and reaches the inversion guide portion 16, and thereafter the frame 48, the sub-frames 49, the second rollers 46 and the assistant rollers 47 downwardly rotate integrally around the center axis 52 (see FIG. 4) as the rotation center. In this state, the path switching portion 41 is placed in a state shown in FIG. 7C.

Then, the first roller 45 is rotated reversely to convey the recording sheet 103 to the inversion guide portion 16 and further convey the recording sheet 103 to the conveyance roller 60. Thereafter, the reverse driving of the first roller 45 is stopped and the sheet feed roller 25 is driven to thereby convey the recording sheet 103 again to the conveying path 23.

Although, at the operation S109, the recording sheet 103 is slightly conveyed to the sheet discharge tray 21 before rotating the path switching portion 41 downward, since only the rear end portion in the conveying direction of the recording sheet 103 remains near the first guide surface 32, the path switching portion 41 may be rotated downward without slightly conveying the recording sheet 103 at the operation S109.

Next, it is confirmed whether the recording sheet 103 reaches the second dry position at operation S110. At the operation S110, the rotary encoder 87 detects the rotation amounts of the first roller 45 and the sheet feed roller 25, and then the CPU 88 calculates the conveyed amount of the sheet to thereby determine whether the recording sheet 103 reaches the second dry position.

Of course, a registration sensor may be provided at the portion corresponding to the second dry position and it may be determined in accordance with the detection result of the registration sensor whether the front tip end in the conveying direction of the recording sheet 103 reaches the second dry portion.

At operation S110, if it is determined that the front tip end in the conveying direction of the recording sheet 103 does not reach the second dry portion (No in S110), the recording sheet 103 is continuously conveyed by the sheet feed roller 25. In contrast, if it is determined that the front tip end (leading end) in the conveying direction of the recording sheet 103 reaches the second dry portion (Yes in S110), the driving operation of the sheet feed roller 25 is stopped at operation S111. This state is shown in FIG. 7C, in which the front tip end in the conveying direction of the recording sheet 103 stops in a bent state in the conveying path 23.

If the recording sheet 103 is placed in the second dray standby state, the value stored in the second dry time storage area 90*c* of the RAM 90 is read and the starting time of the CPU 88 is set at operation S112. In this exemplary embodiment, since the dry time of the second dray standby state is set to be 30 seconds in advance, the operation S115 and the succeeding operations of the printing processing are started after 30 seconds.

When the starting time of the CPU 88 is set at the operation S112, the multifunction device 10 enters the power saving mode at operation S113. The power saving mode entered at the operation S113 is same as the power saving mode entered at the operation S106.

The second dry standby state is shorter than the first dray standby state. This is because almost all of the ink is dried by the first dray standby state. Further, the front side portion in the conveying direction of the recording sheet 103 is curled in the second dray standby state. By curling the front portion, the recording sheet 103 having been wet by the ink can be suppressed from being deformed (deformation such as waving, for example), and therefore, the recording sheet 103 can be conveyed smoothly and the recording portion 24 can record optimally.

Next, it is confirmed whether the clock circuit of the CPU 88 has counted the number corresponding to 30 seconds, that is, the second dry time has lapsed after entering the power saving mode at operation S114, and the power saving mode is continued until the second dry time lapses (No in S114).

When it is confirmed at the operation S114 that the second dry time has lapsed after entering the power saving mode (Yes in S114), the multifunction device 10 enters the normal power mode like the operation S108 at operation S115.

When entering the normal power mode at operation S115, the rear face printing processing is performed at operation S116, and the printing processing is completed. In the rear face printing processing at operation S116, the recording portion 24 records an image on the rear face of the recording sheet and the recording sheet 103 recorded thereon is discharged to the sheet discharge tray 21. The path switching portion 41 is controlled so as to be restored to the state of FIG. 7A from the state of FIG. 7C during or after the recording of the rear face of the recording sheet 103 to thereby discharge the recording sheet 103 to the sheet discharge tray 21.

As described above, when the recording sheet 103 is placed in the first dray standby state or the second dray standby state in order to dry the recording sheet 103, the front face of which is printed, the multifunction device 10 enters the power saving mode in which the power supply to the various kinds of sensors and motors is interrupted, so that an amount of the power consumption of the entirety of the multifunction device 10 can be suppressed.

Further, in the first dray standby state, since the recording sheet 103 is held between the first roller 45 and the second rollers 46, even if the power supply to the first roller 45 is interrupted, the recording sheet 103 is prevented from being fallen or positionally misaligned. Further, almost of the recording sheet 103 in the first dray standby state is supported by the sheet discharge tray 21 from the lower side (the recording sheet 103 is supported almost in the horizontal state), the recording sheet 103 is surely prevented from being fallen or positionally misaligned. Further, the recording sheet 103 in the second dray standby state is also held by the sheet feed roller 25 and supported by the inversion guide portion 16 from the lower side, the recording sheet 103 is also prevented from being fallen or positionally misaligned.

For example, in this exemplary embodiment, if the first roller 45 and the second rollers 46 do not hold the recording sheet 103 but merely support the recording sheet, when the multifunction device 10 enters the power saving mode, there may arise a case that the recording sheet 103 falls on the sheet discharge tray 21 and so the rear face of the recording sheet can not be recorded. Thus, the exemplary embodiment is configured to surely hold the recording sheet 103 by the first roller 45 and the second rollers 46.

Further, since the sheet discharge tray 21 is exposed outside in order for a user to take out the recording sheet 103 after the recording (see FIG. 1), the drying of the recording sheet 103 in the first dray standby state can be enhanced.

While the present invention has been shown and described with reference to certain exemplary embodiments thereof, it will be understood by those skilled in the art that various changes in form and details may be made therein without departing from the spirit and scope of the invention as defined by the appended claims.

For example, in the above exemplary embodiment, the predetermined constant values (dry times) are stored as the first and second dry times 89*b*, 89*c* and these constant values are used in the printing processing (see FIG. 6). However, the first and second dry times may be arranged so as to be changed suitably by a user. In this case, the values stored as the first and second dry times 89*b*, 89*c* are stored in the RAM 90 or the EEPROM 91, then the values stored in the RAM 90 or the EEPROM 91 are changed, and the changed values are used in the printing processing. Further, a time suitable for drying the ink adhered to the recording sheet 103 may be calculated based on an amount of the ink ejected at the recording portion 24, and the calculated time may be used in the printing processing.

Further, although, in the above exemplary embodiment, the CPU 88 also enters the sleeping mode when the multifunction device 10 enters the power saving mode, the printing processing executed by the CPU 88 may be continuously executed and it may be determined whether the first dry time and the second dry time has lapsed during the printing processing.

The present invention provides illustrative, non-limiting embodiment as follows:

(1) An image recording apparatus having a both-side printing function for ejecting ink to record images on a first face and a second face of a recording medium, includes: a conveying unit which conveys the recording medium; a driving unit which drives the conveying unit; a conveying path along which the recording medium is conveyed when the conveying unit is driven by the driving unit; a holding unit which is provided on the conveying path and holds a part of the recording medium; and a controller which controls the image recording apparatus to enter a power saving mode of interrupting power supply to at least the driving unit in a state that the recording medium is held by the holding unit, after the image is recorded on the first face of the recording medium but before the image is recoded on the second face of the recording medium.

(2) The image recording apparatus according to (1), may further include a discharge tray on which the recording medium is discharged, wherein the holding unit holds a rear end portion of the recording medium in a conveying direction of the recording medium, the first face of which the image is recorded on, wherein the discharge tray supports the recording medium at a front portion in the conveying direction of the recording medium from the second face, and wherein the front portion is located front from the portion held by the holding unit in the conveying direction.

(3) The image recording apparatus according to (1) or (2), may further include a stopping unit which stops the recording medium, the first face of which the image is recorded on, in the conveying path for a specific time period, wherein the controller controls the image recording apparatus to enter the power saving mode when the recording medium is stopped by the stopping unit.

(4) The image recording apparatus according any one of (1) to (3), may further include: a measuring unit which measures a time elapsed after the image recording apparatus enters the power saving mode, wherein the controller controls the image recording apparatus to enter a normal mode from the power saving mode when the elapsed time measured by the measuring unit exceeds a dry time of the recording medium, the first face of which the image is recorded on, the dry time being stored in advance.

According to the image recording apparatus of (1), when entering the power saving mode of interrupting the power supply to the driving unit by the controller, since the recording medium is held by the holding unit, the recording medium can be prevented from falling or being positionally misaligned-even when the power supply to the driving unit is interrupted. Thus, even in a standby state after the image is recoded on the first face of the recording medium but before the image is recoded on the second face of the recording medium, the power saving can be realized while preventing the falling or the positional misalignment of the recording medium.

According to the image recording apparatus of (2), in addition to the effect attained by the image recording apparatus of (1), since the rear end portion in the conveying direction of the recording medium is held by the holding unit and the front portion in the conveying direction of the recording medium is supported by the discharge tray, the recording medium can be surely prevented from falling or being positionally misaligned due to the recording medium is held by the holding unit and supported by the discharge tray.

Further, the discharge tray is exposed outside in order for a user to take out the recording medium. Thus, since the recording medium, the first face of which the image is recoded on, is exposed outside, the efficiency of the drying can be enhanced.

According to the image recording apparatus of (3), in addition to the effect attained by the image recording apparatus of (1) or (2), since the power supply to at least the driving unit is interrupted when the recording medium, the first face of which the image is recorded on, is stopped by the stop unit for the specific time period in the conveying path, the power saving can be realized even in a state that the recording medium is stopped in the conveying path.

Further, since the recording medium can be stopped in the conveying path for the specific time period, ink ejected onto the recording medium can be dried in a state that the front tip end in the conveying direction of the recording medium is made close to a recording portion for ejecting the ink. Thus, since the recording by the recording portion can be performed quickly after completing the drying of the recording medium, the recording medium can be recorded efficiently.

According to the image recording apparatus of (4), in addition to the effect attained by the image recording apparatus of (1) to (3), when the elapsed time measured by the measuring unit exceeds the dry time of the recording medium, the first face of which the image is recorded on, since the normal mode is restored from the power saving mode, the normal mode can be restored in a time suitable for the dry time and so the recording operation of the recording medium can be performed efficiently.

What is claimed is:

1. An image recording apparatus having a both-side printing function for ejecting ink to record first and second images on a first face and a second face of a recording medium, respectively, the image recording apparatus comprising:

a conveying unit which conveys the recording medium;

a driving unit which drives the conveying unit;

a sensor which operates by supplied electric power;

a conveying path along which the recording medium is conveyed when the conveying unit is driven by the driving unit;

a holding unit which is provided on the conveying path and holds a part of the recording medium; and a controller which, after the first image is recorded on the first face of the recording medium, but before the second image is recorded on the second face of the recording medium, controls the image recording apparatus to enter a power saving mode that interrupts power supply to at least the driving unit and the sensor when the recording medium is held by the holding unit.

2. The image recording apparatus according to claim 1, further comprising a discharge tray on which the recording medium is discharged, wherein the holding unit holds a rear end portion of the recording medium in a first conveying direction of the recording medium, the first conveying direction indicating a conveying direction of the recording medium when the first image is recorded on the first face, wherein the discharge tray supports the recording medium at a front portion in the first conveying direction of the recording medium from the second face, and wherein the front portion is located in front in the first conveying direction with respect to the portion held by the holding unit.

3. The image recording apparatus according to claim 1, further comprising:

a measuring unit which measures a time elapsed after the image recording apparatus enters the power saving mode; and a stopping unit, wherein when the elapsed time measured by the measuring unit exceeds a predetermined time period, the controller controls the image recording apparatus to enter a normal mode where power is supplied to the at least the driving unit and the sensor, to which the power supply is interrupted in the power saving mode, and the driving unit causes the conveying unit to return the recording medium to the conveying path for recording the second image on the second face, wherein the stopping unit stops the recording medium in the conveying path for a specific time period after the image forming apparatus is returned to the normal mode and the recording medium is returned to the conveying path and before the second image is recorded on the second face, and wherein the controller controls the image recording apparatus to enter the power saving mode when the recording medium is stopped by the stopping unit.

4. The image recording apparatus according to claim 1, further comprising:

a measuring unit which measures a time elapsed after the image recording apparatus enters the power saving mode;

wherein the controller controls the image recording apparatus to enter a normal mode where power is supplied to the at least the driving unit and the sensor from the power saving mode when the elapsed time measured by the measuring unit exceeds a dry time of the recording medium, the dry time being stored in advance.

5. The image recording apparatus according to claim 1, wherein the sensor detects the recording medium conveyed by the conveying unit.

6. The image recording apparatus according to claim 5, wherein the sensor comprises an optical sensor.

7. The image recording apparatus according to claim 1, wherein the conveying unit comprises a conveying roller, and wherein the sensor detects a rotation of the conveying roller.

8. The image recording apparatus according to claim 1, wherein the sensor detects a movement of a recording head which ejects ink to record an image.

9. An image recording apparatus comprising:

a conveying roller which conveys a recording medium along a conveying path in a conveying direction;

an image recording unit which is provided along the conveying path and ejects ink on the recording medium conveyed by the conveying roller to form an image thereon;

a discharge tray;

a driven roller which is freely rotatable;

a discharge roller which, while nipping the recording medium with the driven roller, discharges the recording medium having the image recorded thereon to the discharge tray or conveys the recording medium having the image recorded thereon to an inverse path which extends to an upstream side of the conveying path with respect to the image recording unit in the conveying direction;

a driving unit which drives the conveying roller and the discharge roller;

a sensor which operates by supplying electric power; and a power controller which controls power supply to the driving unit and the sensor to be interrupted when the discharge roller nips the recording medium with the driven roller.

10. The image recording apparatus according to claim 9, wherein the sensor detects the recording medium conveyed by the conveying roller.

11. The image recording apparatus according to claim 9, wherein the power controller calculates a first time period based on an amount of ink used in the image to be recorded on the recording medium, and wherein the power controller controls the power supply to the driving unit to be interrupted for the first time period.

12. The image recording apparatus according to claim 9, wherein the conveying path has a U-shape, the U-shape comprising a turning portion, and wherein the power controller controls power supply to the driving unit in a state that the conveying roller contacts with the recording medium and a leading end portion of the recording medium is at the turning portion in the conveying path.

13. The image recording apparatus according to claim 9, wherein the sensor detects a rotation of the conveying roller.

14. The image recording apparatus according to claim 9, wherein the sensor detects a movement of a recording head of the image recording unit.

* * * * *